US006662386B1

(12) United States Patent
Bowerman

(10) Patent No.: US 6,662,386 B1
(45) Date of Patent: Dec. 16, 2003

(54) SHOWER BACK SCRUBBING DEVICE

(76) Inventor: Rickie Allen Bowerman, 4170 3rd Ave. SW., Naples, FL (US) 34119

( * ) Notice: Subject to any disclaimer, the term of this patent is extended or adjusted under 35 U.S.C. 154(b) by 0 days.

(21) Appl. No.: 10/299,072

(22) Filed: Nov. 19, 2002

(51) Int. Cl.[7] ..... A47K 7/02
(52) U.S. Cl. ..... 4/606
(58) Field of Search ..... 4/606; 15/21.1, 15/104.92

(56) References Cited

U.S. PATENT DOCUMENTS 3,042,949 A * 7/1962 Mosely ..... 15/21.1
3,078,484 A * 2/1963 Briggs ..... 15/21.1
4,008,503 A * 2/1977 Tharp ..... 15/88.3
4,151,623 A * 5/1979 Steere ..... 15/21.1
4,155,137 A * 5/1979 Kadlub ..... 15/4
4,490,871 A * 1/1985 Martin ..... 15/21.1
4,704,756 A * 11/1987 Williams et al. ..... 15/21.1
5,065,463 A * 11/1991 Le ..... 4/606
5,567,869 A * 10/1996 Hauch et al. ..... 73/64.41
6,338,170 B1 * 1/2002 De Simone ..... 4/606

* cited by examiner

*Primary Examiner*—Charles E. Phillips

(57) ABSTRACT

The invention is directed to a back brushing device which is being installed on the wall of a shower stall and is connected to a power supplying the shower head with water which also supplies water to the device for driving the same. The device itself consists of a housing having two gear wheels therein which are intermeshing. Each of the gear wheels has a peg protruding therefrom which in turn fits into slots in the back of the brushes. When the wheels are rotating each of the pegs takes the slot along in an up and down movement whereby the brushes move up and down in a reciprocating motion either in an opposing motion or in unison depending on how the gear wheels are installed.

8 Claims, 5 Drawing Sheets

SHOWER BACK SCRUBBING DEVICE

CROSS REFERENCE TO RELATED APPLICATION (none)

STATEMENT REGARDING-FED SPONSORED R & D (none)

BACKGROUND OF THE INVENTION

This invention relates to a bathing accessory, and more particularly to a back scrubber. The accessory or device is attached to a shower wall and water is piped into the device from the shower head water pipe. The water causes at least two brushes to reciprocate in a vertical direction in unison or relative to each other.

DESCRIPTION OF THE PRIOR ART

U.S. Pat. No. 3,875,604 shows a brushing device that is attached to shower wall. The device is supplied with water under pressure through a pipe coming from the shower head pipe. The brushing device is a rotary brush rotating in the horizontal direction and moving up and down at the same time. The invention at hand discloses at least two reciprocating brushes.

U.S. Pat. No. 4,151,623 illustrates a bathing device in the form of a rotating brush that is mounting on a vertical bar on which the rotating brush can be moved to different vertical positions. Water under pressure is supplied from the pipe that feeds the water to the shower head.

U.S. Pat. No. 4,155,137 shows a hand-held shower head that delivers water either to a water discharge shower head or to a rotary brush. The rotary brush is driven by a paddle wheel in a housing.

U.S. Pat. No. 4,704,756 illustrates a shower brush device which incorporates a single reciprocating brush that is driven by a water pump operated by water diverted from the shower head supply. This is the only reciprocating brush element found in the prior art. The invention at hand operates two brush elements at the same time either in unison or reciprocating in opposite directions.

U.S. Pat. No. 4,955,101 discloses a body brushing brush mounted on a wall in a shower including means for non-rotatably moving the brush in a small orbit such movement is achieved with an hydraulic drive mechanism. This is not the reciprocating brush movement of at least two brushes of the invention at hand.

U.S. Pat. No. 5,345,640. This patent discloses the use of a multiple of rotary brushes mounted on a housing which can be mounted to the wall of a shower by way of suction cups.

U.S. Pat. No. 5,561,869 illustrates a shower mounted washing apparatus. The apparatus can be moved up and down to various positions to accommodate the desires of a person taking a shower. Like explained in the previous patent above, the apparatus includes a multiple of rotating brushes in addition to a hand-held brush for the convenience of the bather.

U.S. Pat. No. 5,774,907 shows a brush system which is mounted to the wall of the shower. The brush system is stationary and the bather has to provide for a relative movement against the brush the brush element has a system whereby water sprays will emanate from the brush bristles onto the body part of the bather. This is not the disclosure of the invention at hand.

U.S. Pat. No. 5,870,782 discloses a fitness-brush shower installation consisting of a rotary brush that is driven by an electric motor through various driving elements. Applicant is shying away from the use of any electric motors in any shower environment.

U.S. Pat. No. 6,338,170 illustrates a hand-held shower scrubbing device that can be mounted on a shower wall and can be adjusted in any vertical positions the device itself includes one or more spouts, one or more sponges, rolls or similar interchangeable massaging means which can be handled by the user and/or hang on the wall or the bathtub.

BRIEF SUMMARY AND OBJECTS OF THE INVENTION

One object of the invention is to present a simple and low cost appliance that can easily be installed and handled. The device involves a minimum of movable parts. The water supply to drive the device is obtained from a conventional shower head equipped with a T-valve and a valve actuator handle. A connecting flexible pipe connects the valve and back scrubber assembly or device for conveying water to be used to drive the back scrubber assembly. The back scrubber device includes two brushes that are reciprocating in unison or in an alternating mode.

DETAILED DESCRIPTION OF THE INVENTION

Figure 1B:
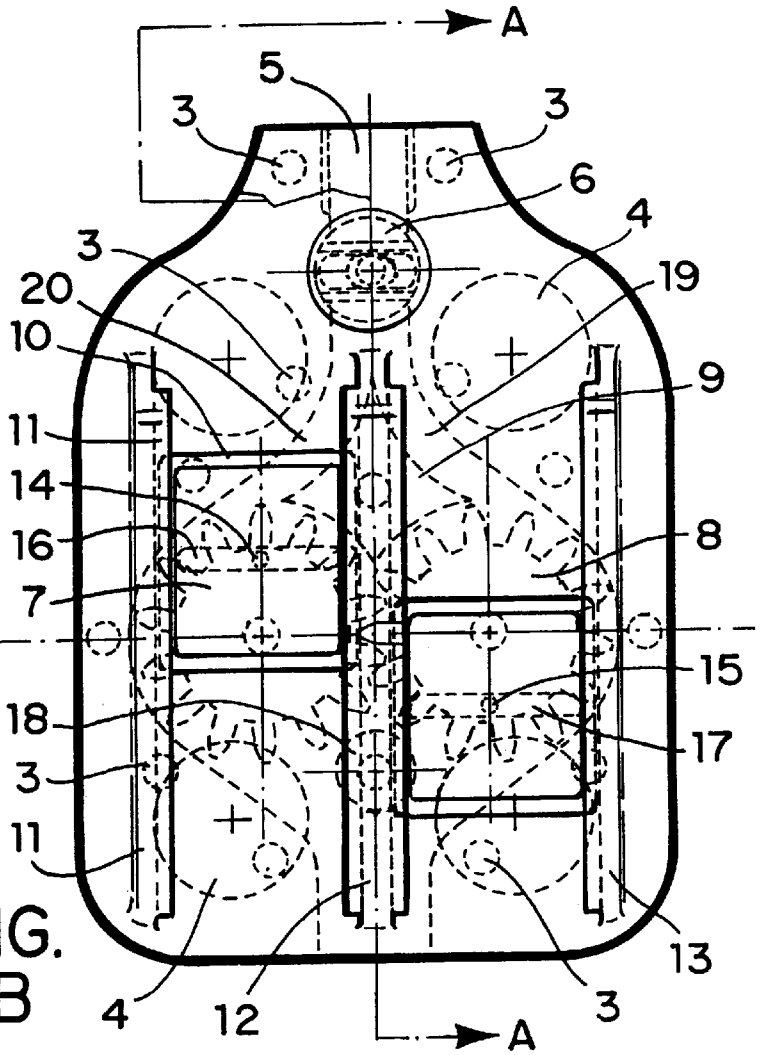
FIG. 1B is a front view exposing the drive wheels and the water flow.
Figure 1A:
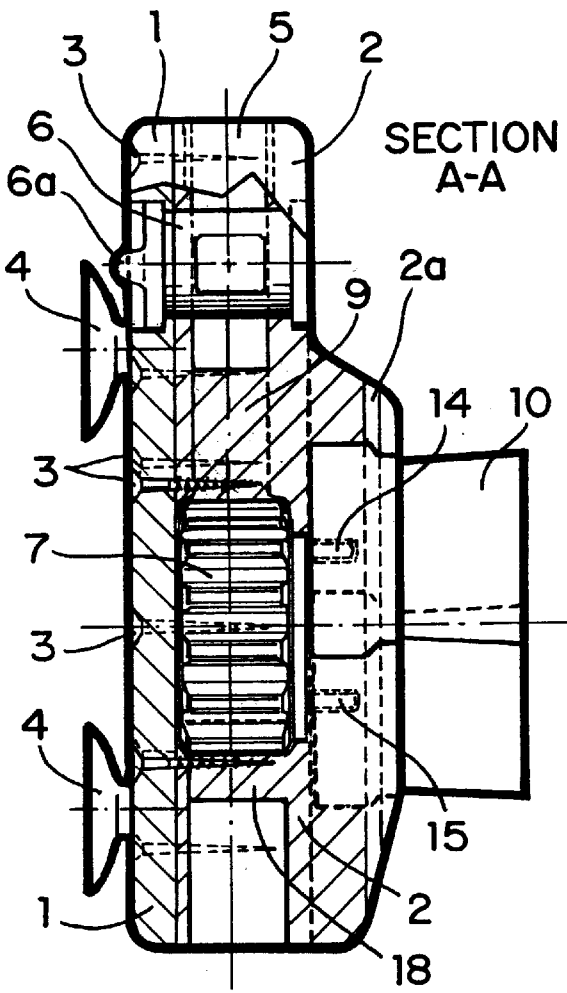
FIG. 1A is an open side view of section A—A taken along section A—A of FIG. 2 exposing the driving gears and a brush.

FIGS. 1A and 1B show the basic drive housing as consisting of two parts such as 1 being the back plate and 2 being the front housing. The two parts are connected by a multiple of screws 3. The back plate 1 is mounted on the wall of a shower stall by way of at least four suction cups 4. The water inlet into the housing 2 is shown at the top at 5 having a shut off valve 6 below the inlet 5. The shut-off valve 6 can be activated by a handle or knob 6*a*. The brushes 10 are activated by two water gears 7 and 8. On the front of the front housing 2 there is provided a housing cover 2*a* which contains the brushes 10 and the guide ways to operate the brushes. Within the housing 2*a* the gears 7 and 8 each have a driving pegs 14 and 15 thereon which pegs will slide in the grooves 16 and 17 in the brushes to move the brushes up and down as the gears are rotating, as will be explained below. At 18 there is shown a spacer block which is instrumental at rigidifying the cover 1 and the housing 2 as they are screwed together by screws 3. Such a block prevents the gear wheels 7 and 8 from jamming in case the screws 3 are tightened too hard.

When the water under pressure enters the water inlet 5 and is thereafter divided by the water divider diamond-shaped block 9 into two channels 19 and 20 which guide the water around the gear wheels 7 and 8 which then will rotate The drive pegs 14 and 15 on the wheels 7 and 8, respectively, will rotate with gear wheels 7 and 8 and at the same time will reciprocate the brushes up and down because the drive pegs 14 and 15 are riding in the grooves 17 and 16, respectively, in the back of the brushes 10. The drive wheels can be oriented relative to each in such a manner so that the brushes are reciprocating in unison or in an alternating manner.

Figure 2:
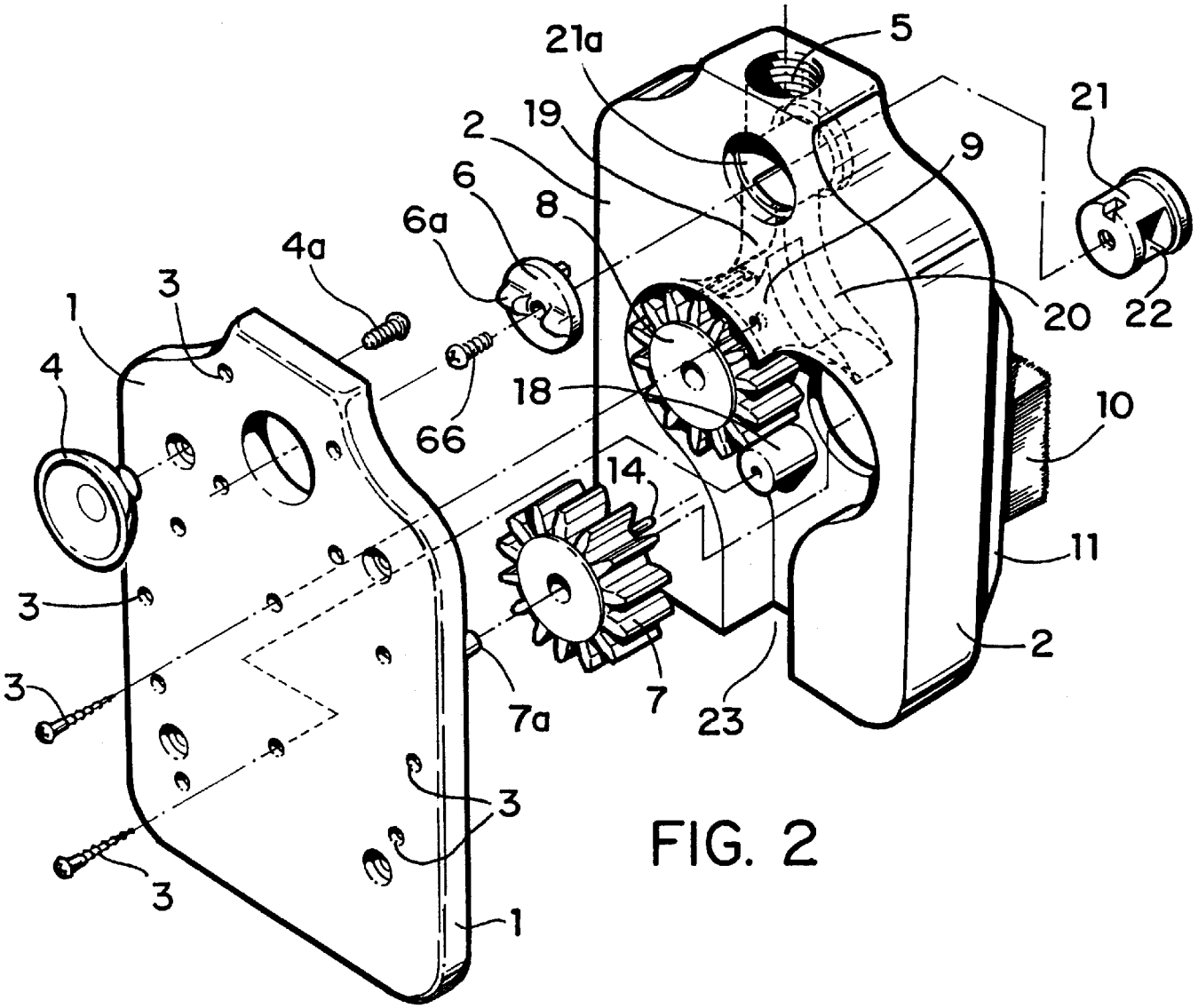
FIG. 2 is an exploded view of the inside driving mechanism.

In FIG. 2 the same reference characters have been applied to the same elements as were shown in FIGS. 1A and 1B. The view in FIG. 2 has been exploded to better understand the motion of the wheels and the brushes. At the top of the housing 2 and just below the water inlet 5 there is a lateral opening 21*a* which receives the valve body 21 having a through passage 22 therein. The valve 21, once it is installed is attached to the valve actuator 6 by way of the fastening screw 6*b*, once the valve body is rotated by the actuator knob 6*a*, the water flow is either restricted or in full flow depending on the position of the valve body with its through passage 22. FIG. 2 also illustrates the fastening of the suction cup 4 by way of the screw 4*a*.

Figure 3:
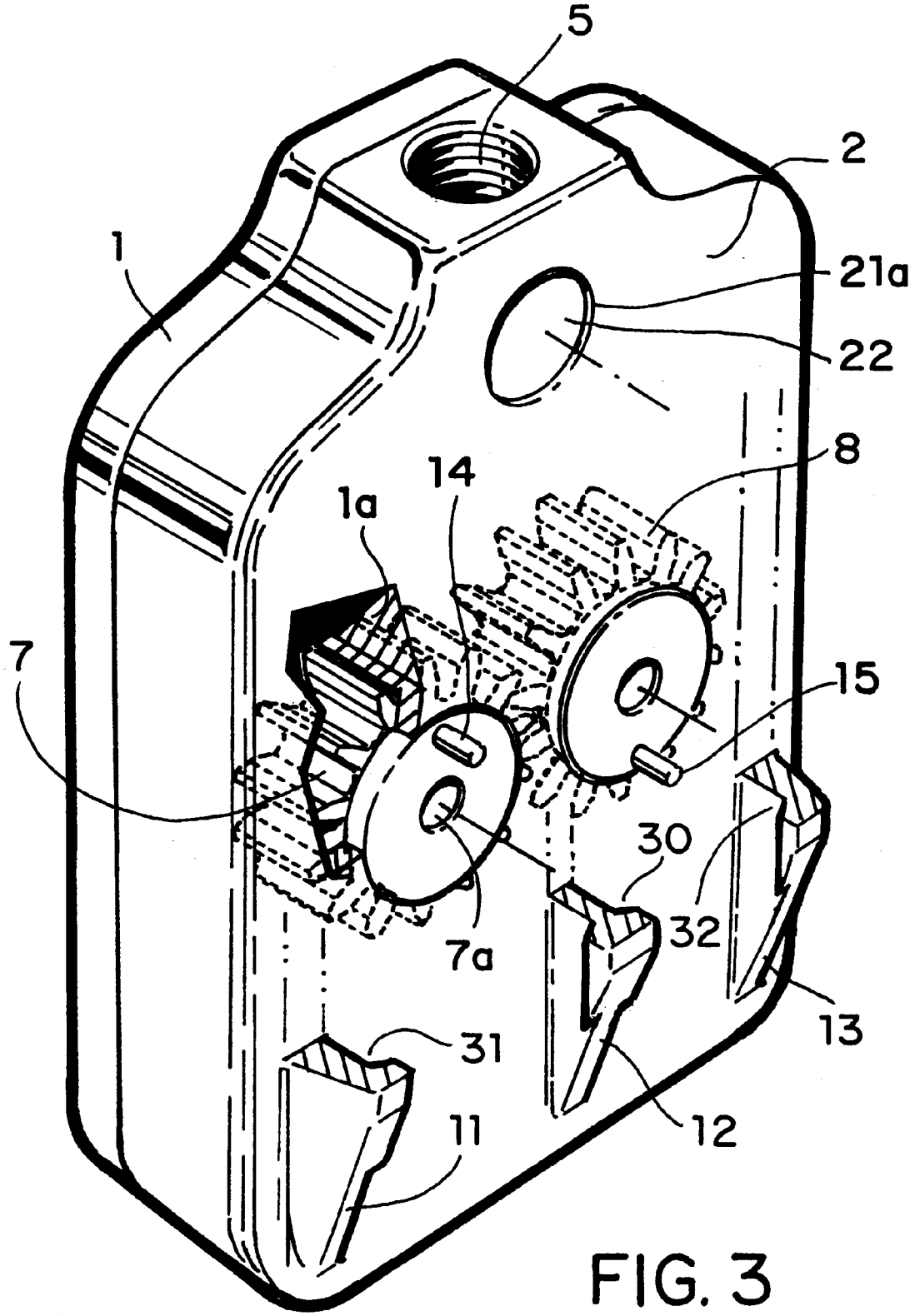
FIG. 3 shows the mounting channels for the brushes including the gears.

FIG. 3 shows the outside of the housing 1 and 2 with the gears 7 and 8 shown in phantom and a breakaway of the housing including the driving pegs 14 and 15. At the bottom of the housing there are located the brush guide bars 11, 12 and 13. The guide bars are broken away for a better view but they are extending almost the full length of the front of the housing 2. The guide bars, on their inner edges, have a dovetail configuration 31, 32 and 30. This is so that a similar configuration on the back of the brushes 40*a* and 41*a* (FIG. 4) retains the brushes within the guides while they are reciprocating up and down FIG. 3 again shows the driving pegs 14 and 15 on the driving gears 7 and 8.

Figure 4:
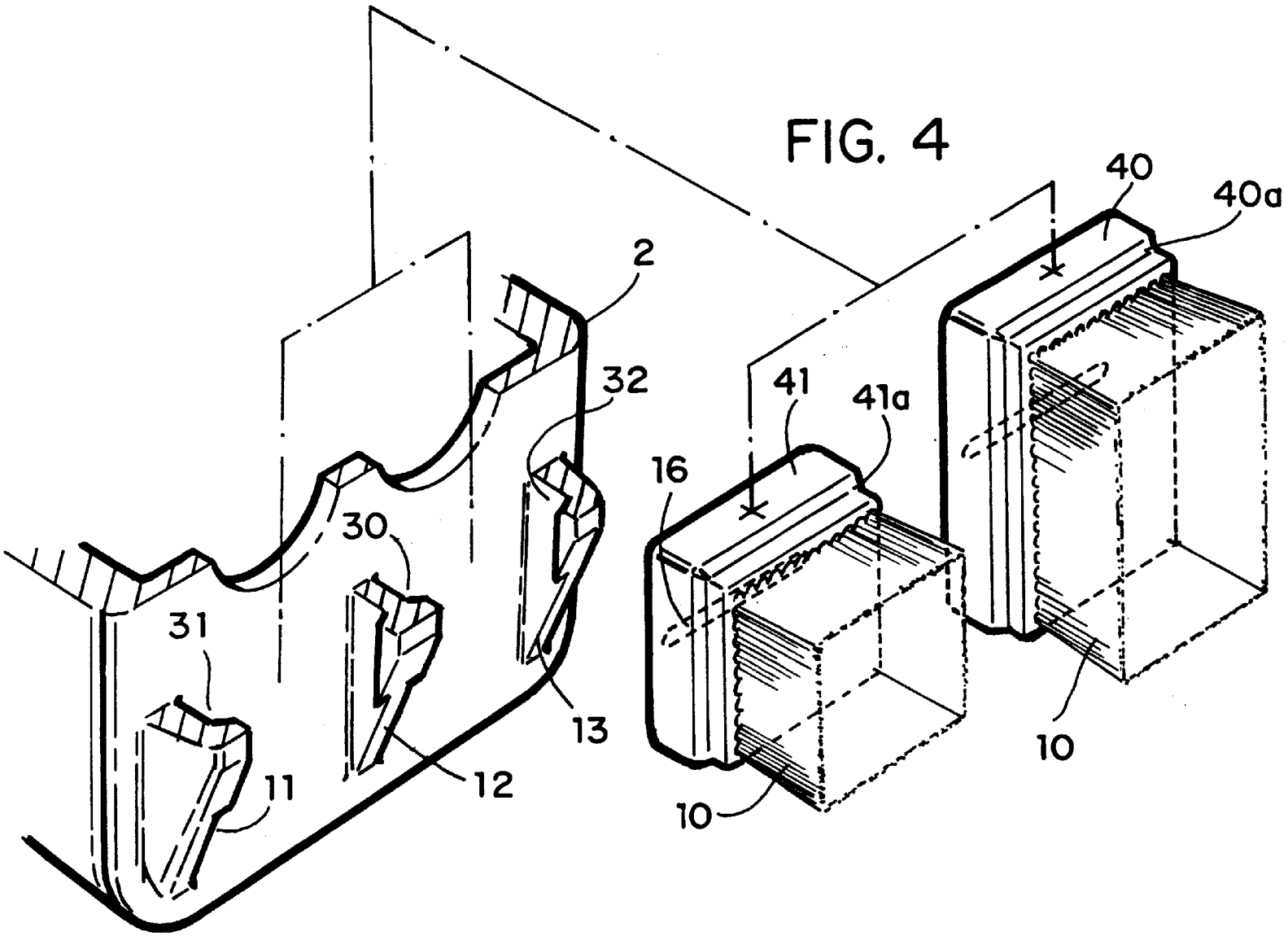
FIG. 4 illustrates a mounting arrangement for the brushes.

FIG. 4 shows the sliding motion of the brushes 10 in more detail again like reference characters have been applied to like elements of the previous Figs. The back of each brush 10 has a block 40 and 41, respectively and the face of the blocks closest to the brush are chamfered at 40*a* and 41*a* to be able to ride against the dovetailed edges 31, 32 and 32 of the guides 11, 12 and 13.

Figure 5:
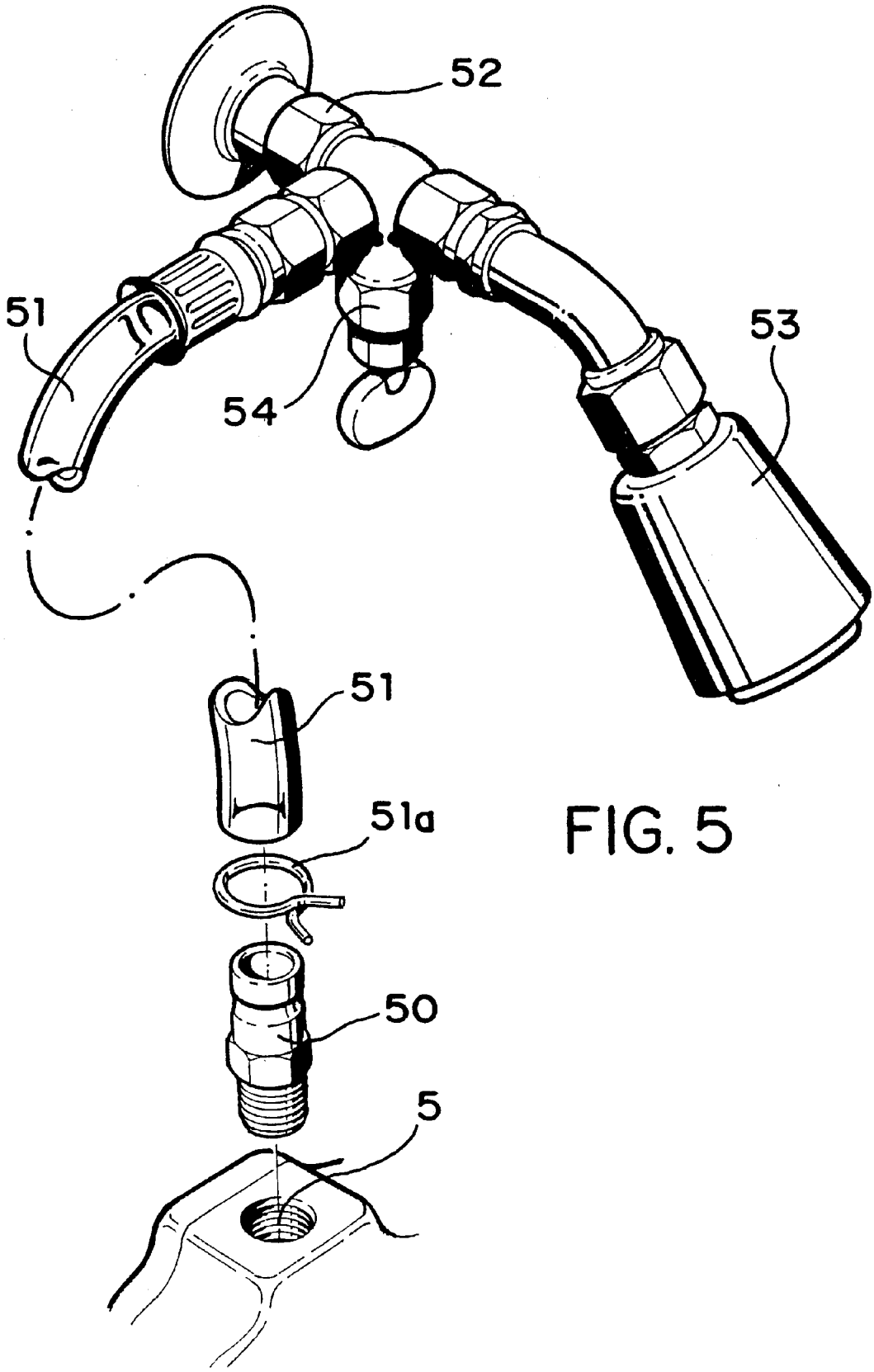
FIG. 5 shows the water connection to a shower head.

FIG. 5 shows how the appliance housing is connected to a standard shower head pipe head pipe 52. The forward end of the pipe 52 has a standard shower head 53 connected thereto. Along the pipe there is a water shutoff spigot 54 installed which directs water to either the shower head 53 or into the flexible pipe 51 which is connected to the inlet 5 of the housing 1 and 2 by way of a nipple 50 and a clamping ring 51*a*. The operation of this connection should be explanatory

What is claimed is:

1. A back brushing device in a shower stall comprising a housing having drive gears therein and enclosed by said housing, said gears being driven by water pressure entering said housing through a water inlet, said inlet of water is divided into two channels with each channel driving each of said wheels into rotating motion, said housing having at least two brushes slidingly mounted on an outer surface of said housing, means connected between said rotating drive gears and said brushes for driving said brushes in straight reciprocating motions.

2. The back brushing device of claim 1, wherein said means connected between said rotating drive gears and said at least two brushes includes a peg connected to each of the drive wheels, said peg of each of said drive wheels is riding in a groove in the back of each of said brushes setting up a reciprocating motion.

3. The back brushing device of claim 2, wherein said gears are adjustable relative to each other to induce said brushes to move in unison or in a motion relative to each other.

4. The back brushing device of claim 1 including guide means on a front surface of said housing, said guide means having means thereon for guiding said brushes in a reciprocating manner.

5. The back brushing device of claim 4, wherein said guide means constitute straight bars having dove tail configurations thereon, said configurations matching similar configurations on the back of said brushes, said configurations retaining said brushes therein for guiding said brushes in a reciprocating motion.

6. The back brushing device of claim 1 including suction cups fastened to a back of said housing for maintaining said housing on a wall of a shower stall.

7. The back brushing device of claim 1 including means for connecting said device to a pipe of said shower stall.

8. The back brushing device of claim 7 including means for shutting off the water supply to said back brushing device.

* * * * *